US010485350B2

(12) United States Patent
Lenhart et al.

(10) Patent No.: US 10,485,350 B2
(45) Date of Patent: Nov. 26, 2019

(54) CLASSROOM CHAIR HAVING A MULTIFUNCTION SEATBACK

(71) Applicant: Krueger International, Inc., Green Bay, WI (US)

(72) Inventors: Tad Edward Lenhart, Cedarburg, WI (US); Timothy Joseph Bouche, Green Bay, WI (US); Scott Anthony Bosman, Green Bay, WI (US); Timothy G. Hornberger, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 15/501,369

(22) PCT Filed: Aug. 2, 2016

(86) PCT No.: PCT/US2016/045121
§ 371 (c)(1),
(2) Date: Feb. 2, 2017

(87) PCT Pub. No.: WO2018/026355
PCT Pub. Date: Feb. 8, 2018

(65) Prior Publication Data

US 2019/0142167 A1 May 16, 2019

(51) Int. Cl.

| | |
|---|---|
| ***A47C 7/40*** | (2006.01) |
| ***A47C 7/54*** | (2006.01) |
| ***A47C 7/62*** | (2006.01) |
| ***A47C 7/00*** | (2006.01) |

(Continued)

(52) U.S. Cl.
CPC ..... *A47C 7/40* (2013.01); *A47C 7/006* (2013.01); *A47C 7/54* (2013.01); *A47C 7/626* (2018.08); *A47C 7/68* (2013.01); *A47C 15/002* (2013.01)

(58) Field of Classification Search
CPC .. A47C 7/68; A47C 7/626; A47C 7/40; A47C 7/54

(Continued)

(56) References Cited

U.S. PATENT DOCUMENTS 828,079 A * 8/1906 Williamson ..... A47B 3/14 182/220
3,220,765 A 11/1965 Hoffmann (Continued)

FOREIGN PATENT DOCUMENTS

CN 104970603 10/2015

OTHER PUBLICATIONS

Office Action for Chinese Patent Application No. 201720895658.2 dated Oct. 9, 2018.

(Continued)

*Primary Examiner* — Syed A Islam
(74) *Attorney, Agent, or Firm* — Andrus Intellectual Property Law, LLP

(57) ABSTRACT

A classroom chair includes a seat and a backrest, where the chair facilitates a wide variety of uses by an occupant. The backrest includes a center section and a pair of armrest sections that extend from the center section. The pair of armrest sections and center section each include a utility surface located in a plane parallel to a seating plane. Each of the armrest sections includes a lower edge positioned above the lowermost portion of the center section, which allows the occupant's legs to be located beneath the armrest sections. In one embodiment, the classroom chair includes a base having four legs. In another embodiment, the base includes two legs joined to a support frame have four stub legs. At least one of the legs extends rearward past the backrest such that the base provides required support for the occupant when the occupant's weight is supported by the backrest.

17 Claims, 8 Drawing Sheets

(51) Int. Cl.
*A47C 7/68* (2006.01)
*A47C 15/00* (2006.01)

(58) Field of Classification Search
USPC ..... 297/163, 411.41
See application file for complete search history.

(56) References Cited

U.S. PATENT DOCUMENTS

| | | | | |
|---|---|---|---|---|
| 3,380,778 | A * | 4/1968 | Barecki | A47C 3/04 297/160 |
| 4,607,882 | A * | 8/1986 | Opsvik | A47C 7/029 297/195.11 |
| 6,135,548 | A | 10/2000 | McGuire | |
| 2011/0062754 | A1 | 3/2011 | Mills et al. | |
| 2014/0312661 | A1* | 10/2014 | Behar | A47C 7/40 297/135 |
| 2015/0282623 | A1 | 10/2015 | Reddig | |

OTHER PUBLICATIONS

Office Action for corresponding Chinese Patent Application No. 201720895658.2 dated Jul. 9, 2018.

U.S. Pat. No. 828,079, issued on Aug. 7, 1906, in the name of William Williamson.

Office Action for corresponding Canadian Patent Application No. 2,961,846 dated Nov. 20, 2018.

Office Action for Canadian Patent Application No. 2,961,846 dated Apr. 5, 2018.

Lei, Leo. 'Trialog Chair'. Datasheet [online]. Leibal LLC, Oct. 3, 2013 [retrieved on May 10, 2016]. Retrieved from the Internet: <URL: http://leibal.com/furniture/trialog-chair/>.

International Search Report and Written Opinion for International Patent Application PCT/US2016/045121 dated Oct. 24, 2016.

International Preliminary Report on Patentability for International Patent Application No. PCT/US2016/045121 dated Feb. 14, 2019.

* cited by examiner

FIG. 7
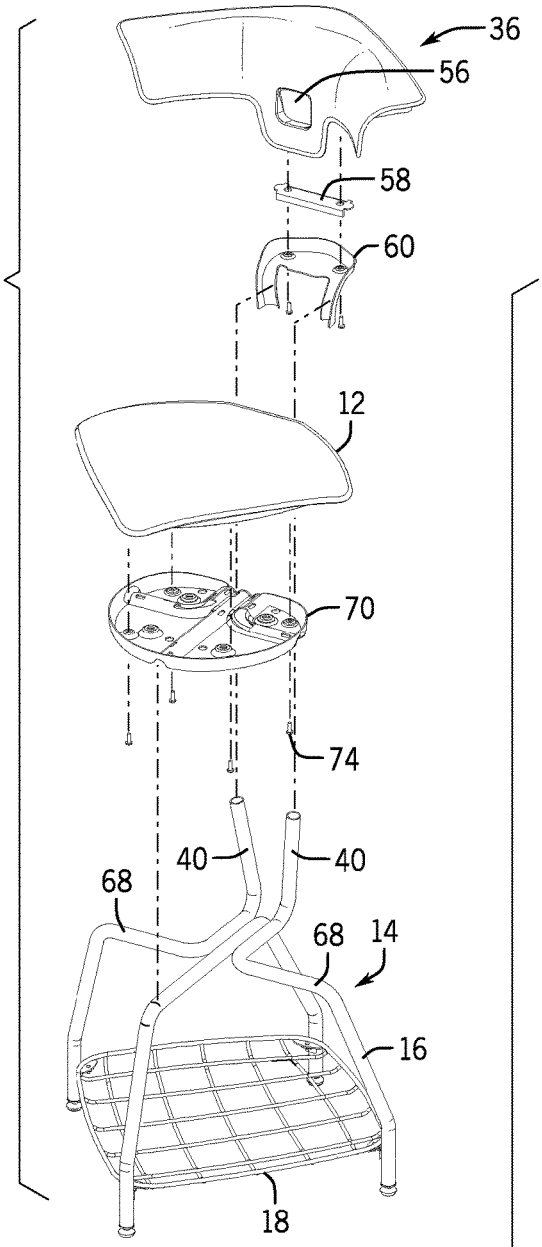
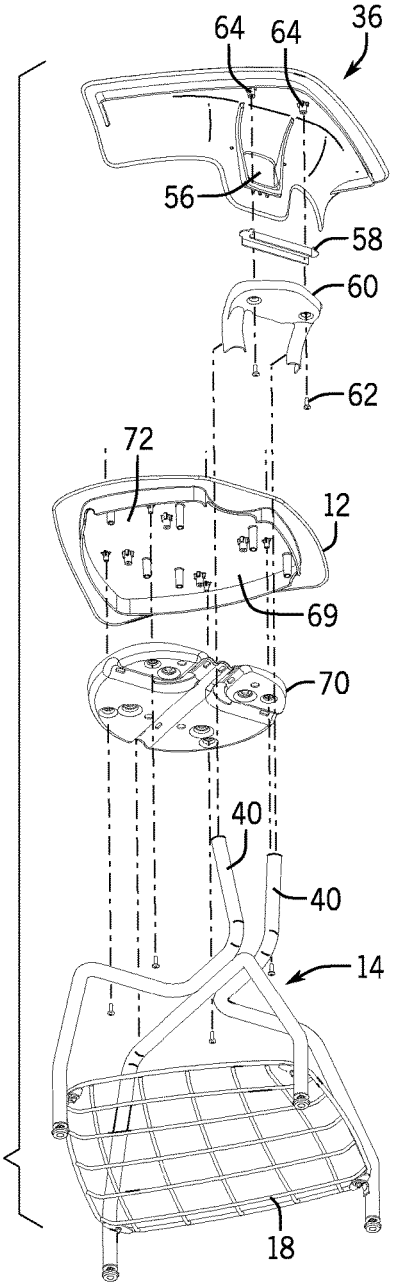
FIG. 8

CLASSROOM CHAIR HAVING A MULTIFUNCTION SEATBACK

CROSS-REFERENCE TO RELATED APPLICATIONS

This application is the U.S. national stage application of unpublished International Application PCT/US2016/045121, filed Aug. 2, 2016.

BACKGROUND

The present disclosure generally relates to a classroom chair. More specifically, the present disclosure relates to a classroom chair that permits multiple different seating positions for an occupant such that the classroom chair can be utilized in many different manners within a classroom or other collaborative setting.

In many current classroom and work environments, the office/classroom furniture, such as desks and chairs, are purchase with the intent that the furniture will be moved on a regular basis within an open workspace. The desks and chairs can be configured and reconfigured in different arrangements and orientations depending upon the requirements of the environment. As an example, when several students or coworkers are working in a small group, the desks and chairs are oriented to provide an intimate working environment. Alternatively, if a large group of students or coworkers are working together, such as during a presentation or lecture, the desks and chairs can be organized in rows or in a manner to focus the attention to a presenter/leader.

Since desks and chairs are often used in multiple different ways within the same classroom or meeting space, it is desirable to have both desks and chairs that can be used in different ways depending upon the current situation.

SUMMARY

The present disclosure relates to a classroom chair that can be used by a seat occupant to facilitate a wide variety of seating and standing positions. The classroom chair of the present disclosure is particularly useful in a collaborative environment in which each of the seat occupants may desire to have a different seating or standing position.

The classroom chair of the present disclosure generally includes a base and a seat that is mounted to the base. The seat includes a seating surface that is located in a generally horizontal seating plane. In one embodiment of the disclosure, the base extending below the seat includes four legs that each engages the floor. In an alternate embodiment, the base includes two legs that extend below the seat and are each joined to a support frame. The support frame is located within a support plane that is generally parallel to the seating plane and is located below the seating plane. In such an embodiment, the support frame includes two stub legs that, along with the chair legs, engage the floor.

The classroom chair further includes a backrest that is positioned above the seat. The backrest includes a back support surface and a utility surface. The utility surface is located in a support plane that is parallel to the seating plane. Preferably, both the seating plane and the support plane define horizontal surfaces. The utility surface is designed to either support a work object or to support the weight of a seat occupant when the seat occupant is in either a standing position or when the seat occupant's entire weight is supported on the backrest in a seating position.

The backrest includes both a center section and a pair of armrest sections that each extend in opposite directions from the center section. Both of the armrest sections and the center section define a portion of both the back support surface and the utility surface.

The backrest sections each include a lower edge that is spaced above the seating plane. The distance between the lower edge of each of the armrest sections and the seating plane allows the seat occupant to position his or her legs beneath the lower edge of either or both of the armrest sections. In this manner, the seat occupant can shift between a wide variety of seating positions.

In both the first and second embodiments of the base, one of the ground-engaging legs of the base is positioned rearward of the outermost portion of the backrest. The location of at least one of the ground-engaging legs rearward of the backrest provides additional support and stability for the classroom chair when a seat occupant is either supported on the utility surface of the backrest or when the seat occupant is resting on the support surface of the backrest.

In accordance with another aspect of the present disclosure, two legs of the base are located on opposite sides of the seating axis. The two legs located on opposite sides of the seating axis are also located rearward of a transverse axis of the seat. The position of the two side legs in each embodiment provides further stability and support for a seat occupant when the seat occupant is either sitting on the support surface of the backrest or leaning against the support surface of the backrest.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 7 is an exploded front view of the classroom chair;

FIG. 8 is an exploded rear view of the classroom chair;

DETAILED DESCRIPTION

FIGS. 1-6 generally illustrate a first embodiment of a classroom chair 10 constructed in accordance with the present disclosure. The classroom chair 10 is designed to provide multiple different seating positions for an occupant along with a utility surface that allows the occupant to use the chair as a rest when the occupant is standing or as a working surface when the occupant is in the seated position.

Figure 1:
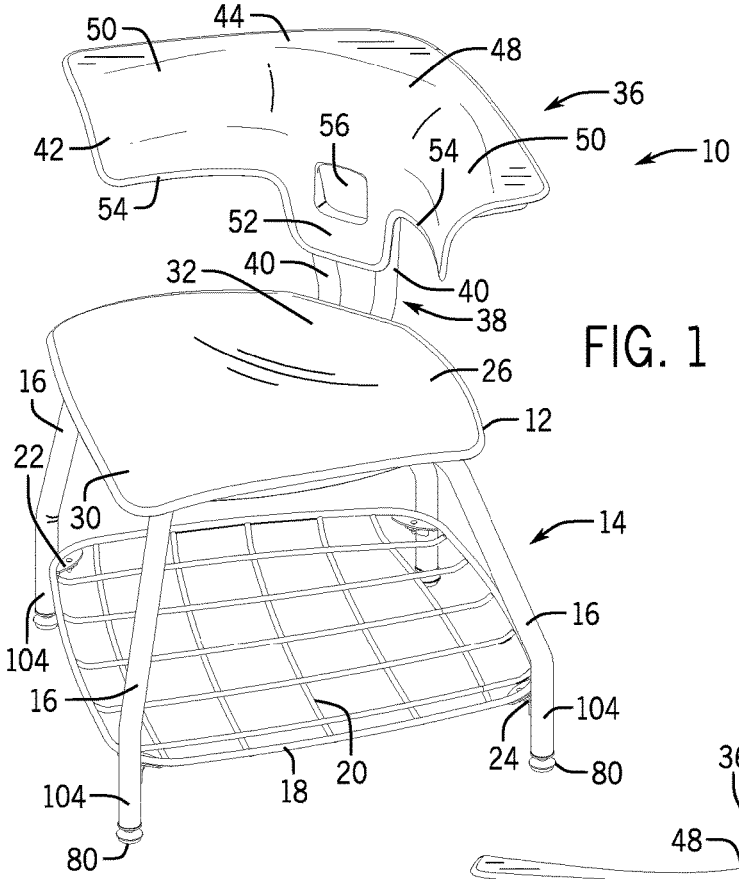
FIG. 1 is a front isometric view of the classroom chair in accordance with the present disclosure.
Figure 2:
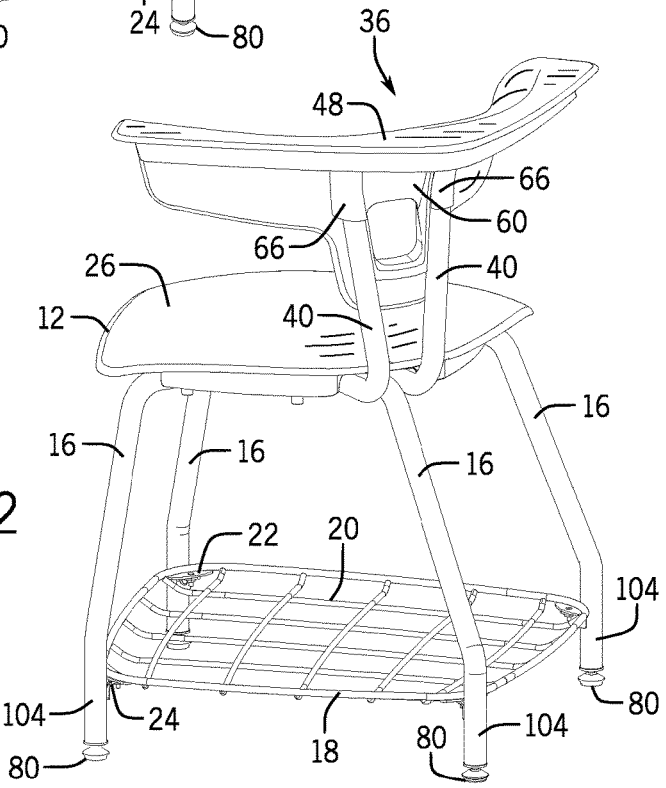
FIG. 2 is a rear isometric view of the classroom chair.
Figure 3:
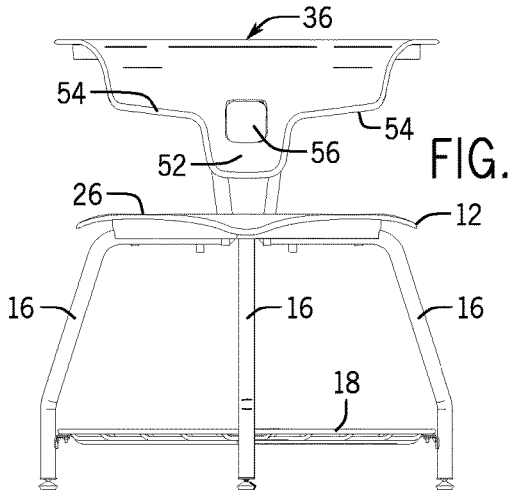
FIG. 3 is a front view of the classroom chair.
Figure 4:
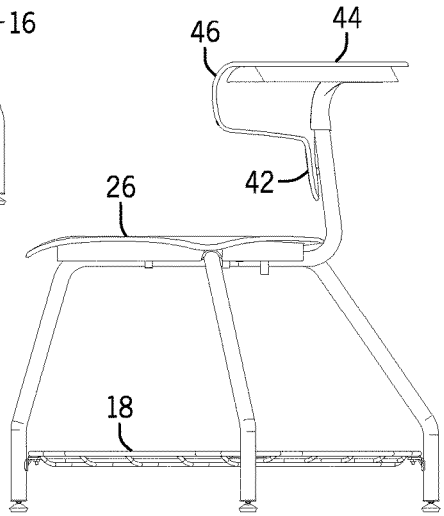
FIG. 4 is a right side view of the classroom chair.
Figure 5:
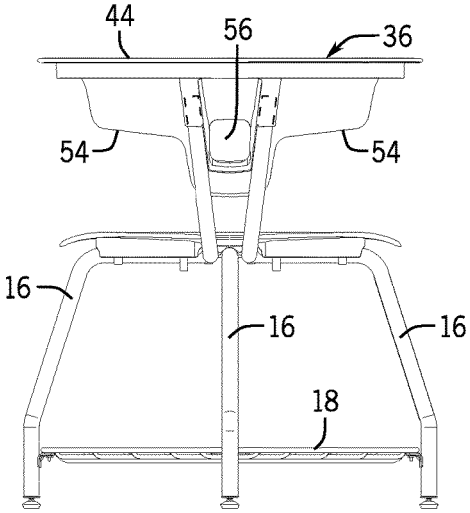
FIG. 5 is a back view of the classroom chair.

The classroom chair 10 includes a seat 12 supported above the floor by a base 14. In the embodiment shown in FIGS. 1-6, the base 14 includes four legs 16 that extend below the seat 12 to support the classroom chair 10 in a known manner. In the embodiment shown in FIGS. 1-6, a book rack 18 extends between the series of legs 16 to provide a support for books or other material below the seat 12. As shown in FIGS. 1-2, the book rack 18 is a wire cage 20 that includes mounting brackets 22 located in each corner. The mounting brackets 22 are connected to a mounting flange 24 formed on each of the legs 16. A connector, such as a screw and nut, is used to secure the book rack 18 between the series of legs 16.

Figure 6:
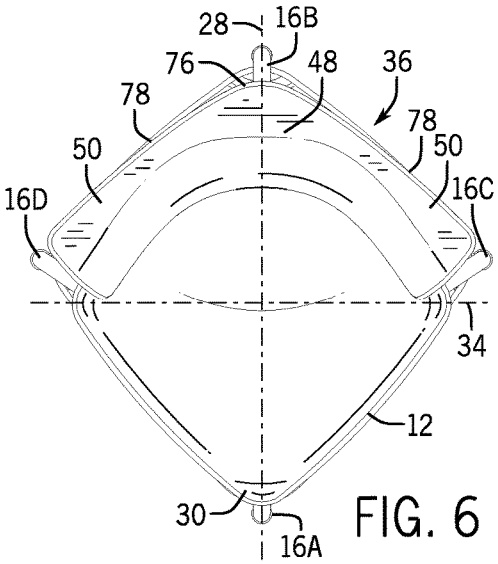
FIG. 6 is a top elevation view of the classroom chair.

The seat 12 defines an upper seating surface 26 that is substantially planar and defines a generally horizontal seating plane. As can best be seen in FIG. 6, the seat 12 is centered along a seating axis 28. When viewed from above, the seat includes a front 30 and a back 32 (FIG. 1). A transverse axis 34 that is perpendicular to the seating axis 28 bisects the seat 12, as also illustrated in FIG. 6. The transverse axis 34 extends through the leftmost and rightmost portions of the seat 12.

Referring back to FIGS. 1 and 2, the classroom chair 10 includes a backrest 36 that is mounted to a back rest support frame 38. The back rest support frame 38 includes a pair of support tubes 40.

The backrest 36 is a molded component that includes a back support surface 42 and a utility surface 44. The utility surface 44 is located in a support plane that is generally parallel to the seating plane that includes the seating surface 26. In the embodiment illustrated, both the utility surface 44 and the seating surface 26 extend in generally horizontal planes that are spaced from each other, which can be best seen in FIG. 4. The back support surface 42 is generally vertical and the curved transition area 46 provides a smooth transition from the back support surface 42 to the utility surface 44.

As can best be seen in FIGS. 1 and 6, the backrest 36 includes a center section 48 and a pair of armrest sections 50 that are located on opposite sides of the center section. Both the center section and the pair of armrest sections 50 include a portion of the utility surface 44 and a portion of the back support surface 42. The center section 48 includes a mounting portion 52 that extends below lower edges 54 that defines the lower most portion of each of the armrest sections 50. The mounting portion 52 includes an opening 56 that is located between the pair of support tubes 40.

As can be understood in FIGS. 7 and 8, the backrest 36 is attached to the pair of support tubes 40 through a mounting bracket 58 and a cover 60. A pair of connectors 62 passes through the cover 60 and mounting bracket 58 and are received within a pair of molded bosses 64 formed in the backrest 36. As can be understood in FIG. 2, the cover 60 includes a pair of tubular portions 66 that surround the support tubes 40 and provide a desired visual appearance from the rear.

As shown in in FIGS. 7 and 8, the seat 12 is mounted to the upper portion 68 of each of the chair legs 16 by a seat pan 70. The seat pan 70 is received in a lower mounting cavity 69 of the seat 12 and rests upon the upper portion 68 of each of the legs 16. A series of connectors 74 are used to attach the seat pan 70 to the seat 12 and the base 14.

As can be understood in the top view of FIG. 6, the center section 48 of the backrest 36 includes an apex 76 that defines the transition from an outer edge 78 of both of the armrest sections 50. The apex 76 is the most rearward portion of the backrest 36 and is generally centered along the seating axis 28.

As shown in FIG. 6, the front leg 16A extends past the front 30 of the seat 12 while the rear leg 16B extends outward past the apex 76. Both the front leg 16A and the back leg 16B are centered along the seating axis 28.

The base includes the pair of side legs 16C and 16D. As shown in FIG. 6, the side legs 16C and 16D are located on opposite sides of the seating axis 28. Further, the legs 16C and 16D are located rearward of the transverse axis 34. Thus, the classroom chair 10 has three points of contact with the floor at a location rearward of the transverse axis 34. The location of these three points of contact will be further described below.

Referring back to FIGS. 1 and 2, the classroom chair 10 is shown as including a glide 80 at the lowermost portion 104 of each of the legs 16. The glide 80 could be replaced with a castor wheel in alternate embodiments.

Figure 9:
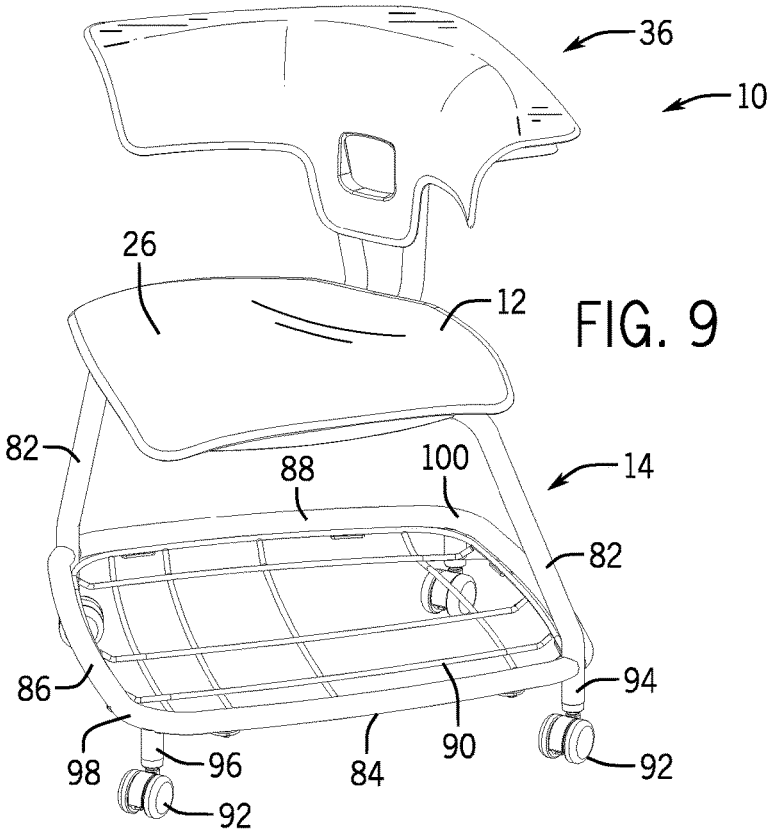
FIG. 9 is a front isometric view of a second embodiment of the classroom chair.
Figure 10:
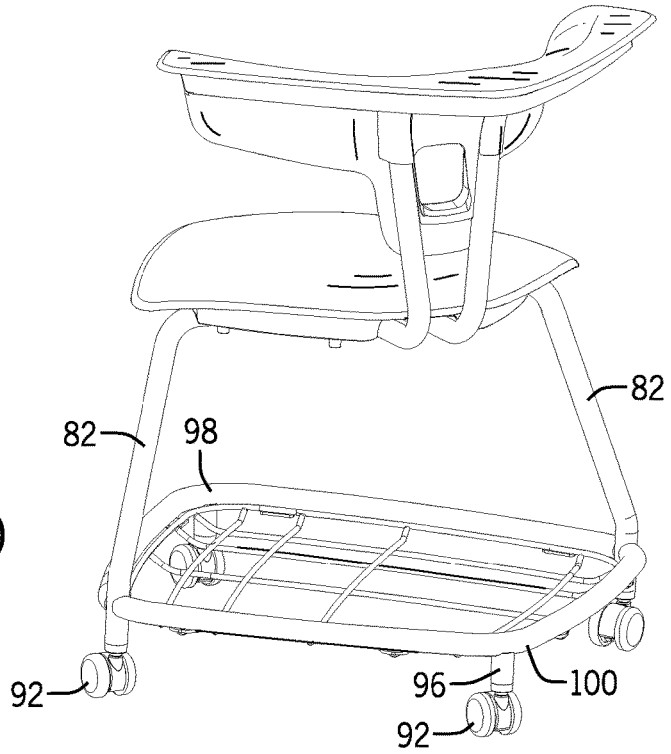
FIG. 10 is a rear isometric view of a second embodiment of the classroom chair.
Figure 11:
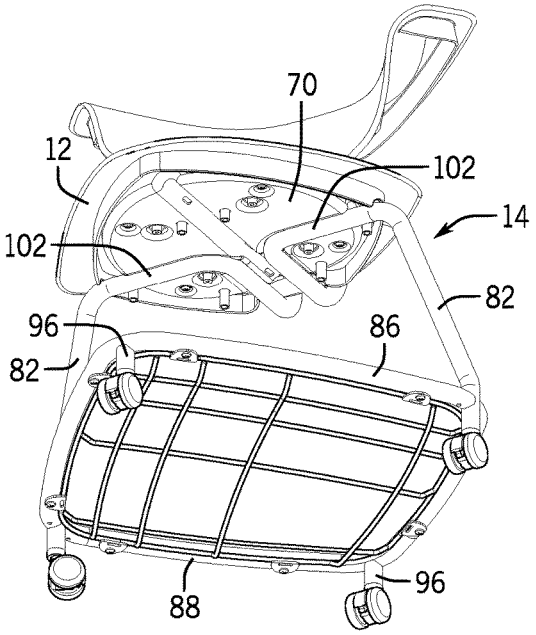
FIG. 11 is a bottom isometric view of the second embodiment.

Referring now to FIGS. 9-11, a second embodiment of the classroom chair 10 is shown. In the second embodiment, the backrest 36 and seat 12 are generally identical to the first embodiment shown in FIG. 1-8. However, in the embodiment of FIGS. 9-11, the base 14 is modified. The base 14 shown in FIG. 9 includes only two legs 82. The pair of legs 82 extend below the seating surface 26 and are each joined to a lower support frame 84. The lower support frame 84 has a general diamond shape formed by a front frame member 86 and a rear frame member 88. The front frame member 86 and the rear frame member 88 are each joined to the pair of legs 82. The support frame 84 provides support for not only a book rack 90 but also a series of castor wheels 92.

Each of the castor wheels 92 is received within either a lower end 94 of one of the legs 82 or a stub leg 96. Stub legs 96 are mounted to the support frame 84 at the curved front end 98 and the curved rear end 100. When viewed from above, the pair of legs 82 are generally in the same location as the side legs 16C and 16D in the embodiment shown in FIG. 6, while the stub legs 96 are in the same location as the front leg 16A and rear leg 16B. In this manner, the points of contact between the classroom chair 10 and the ground are in the same locations as in the embodiment shown in FIG. 6. Once again, although the embodiment shown in FIGS.

9-11 include castor wheels 92, the castor wheels 92 could be replaced with glides such as shown in the embodiment of FIGS. 1-6.

Referring now to FIG. 11, the two legs 82 each include an upper portion 102 received within the seat pan 70. The seat pan 70 is mounted to both the base 14 and the seat 12, as described in the first embodiment above.

Figure 12:
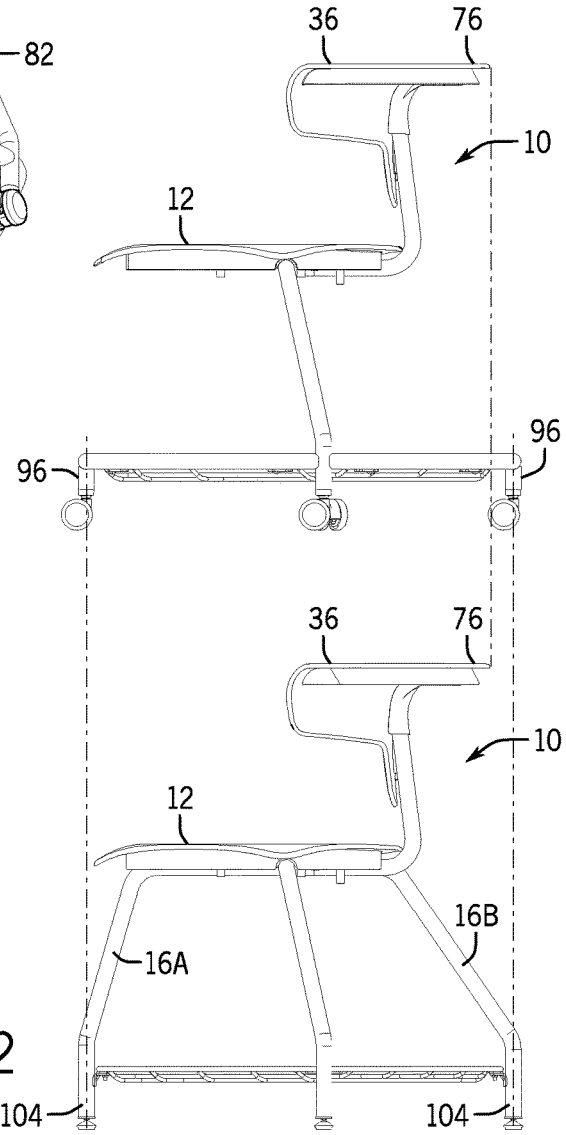
FIG. 12 is a right side view of the first and second embodiments of the classroom chair.

FIG. 12 illustrates a side view of both the first and second embodiments of the classroom chair 10. As can be understood in these views, the apexes 76 of the backrests 36 in each version of the classroom chair are generally aligned with each other. Further, the lower portion 104 of the back leg 16B aligns with the rear stub leg 96 while the lower portion 104 of the front leg 16A aligns with the front stub leg 96. Both the lower portion 104 of the rear leg 16B and the rear stub leg 96 are located outwardly from the center axis of the classroom chair 10, as compared to the apex 76. The location of these two points of contact with the floor enhances the stability of the classroom chair as will be described in greater detail below.

FIGS. 13-26 show and describe various different uses and functions of the classroom chair 10 constructed in accordance with the two embodiments described above. The unique design of the classroom chair 10 allows the classroom chair to be used in a variety of unique and desirable manners, which is particularly suited to a classroom environment.

Figure 13:
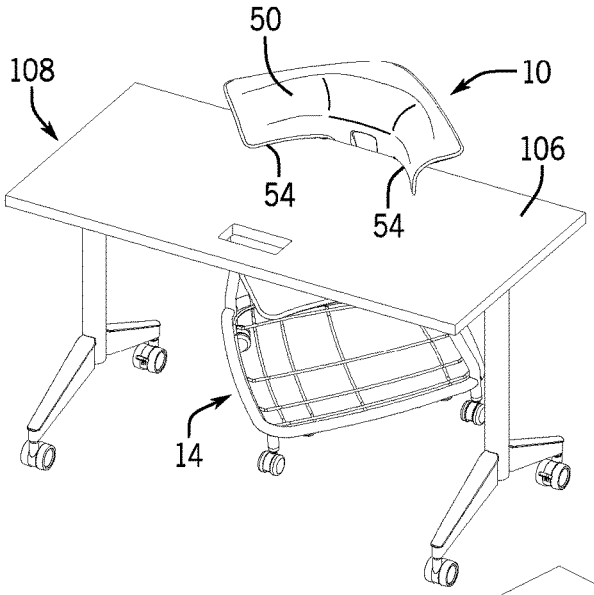
FIG. 13 is a view illustrating the classroom chair supported on a desk.
Figure 14:
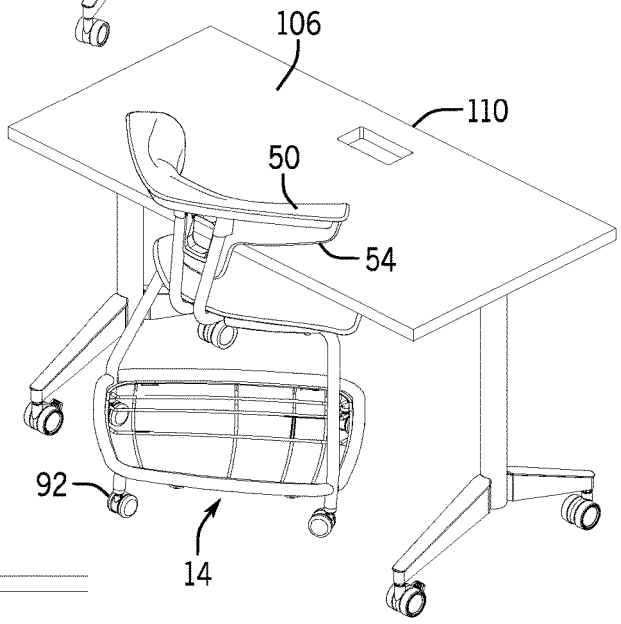
FIG. 14 is a view similar to FIG. 13 showing the classroom chair supported on a desk.
Figure 15:
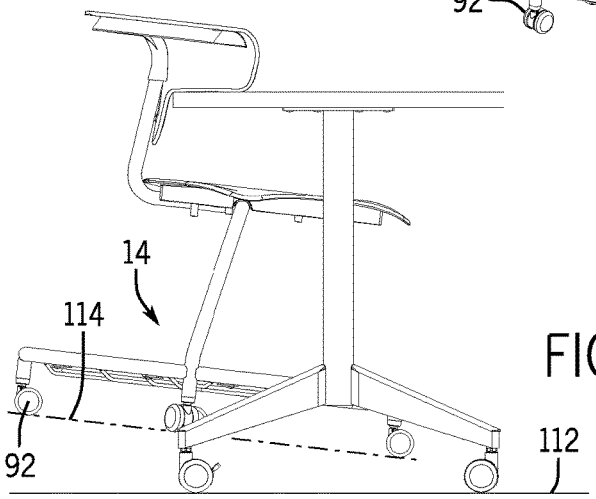
FIG. 15 is a side view illustrating the support of the classroom chair on a desk.

FIGS. 13-15 illustrate the ability of the classroom chair 10 to be hung from a generally horizontal support surface 106 of a desk 108. As shown in FIG. 14, the lower edge 54 on each of the armrest sections 50 contacts the top surface 110 of the desk support surface 106. When in this position, the entire base 14, including the series of castor wheels 92, are positioned above the floor 112, as best shown in FIG. 15. The lower contact plane 114 defined by the series of castor wheels 92 is located a distance above the floor 112 such that a broom can be used to sweep under the desk without having to put the classroom chair 10 completely on top of the desk surface.

Figure 16:
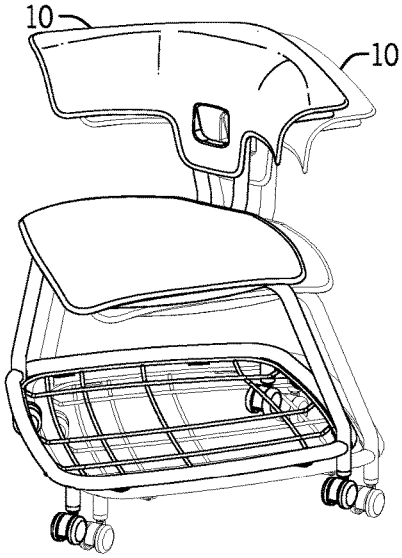
FIG. 16 is a view showing the nesting of the second embodiment of the classroom chair.

FIG. 16 illustrates the ability to stack one or more of the classroom chairs together for storage purposes. In the second embodiment shown in FIGS. 9-11, the base 14 of the classroom chair includes only a pair of legs 82, which allows the chairs to stack as illustrated.

Figure 17:
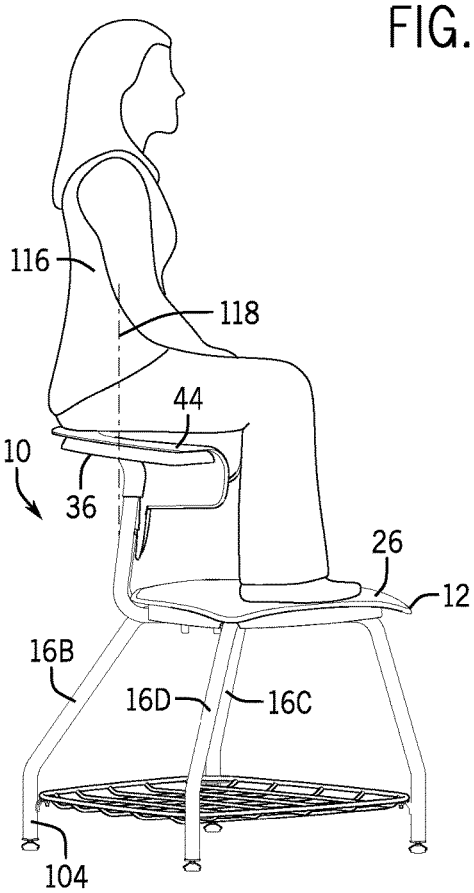
FIG. 17 is a view showing one possible seating position.

FIG. 17 illustrates one contemplated use for the classroom chair 10 constructed in accordance with the present disclosure. In the embodiment shown in FIG. 17, an occupant 116 is shown seated on the backrest 36 with her feet on the seating surface 26 of the seat 12. Specifically, the occupant's weight is received on the utility surface 44. In this position, the center of weight for the occupant 116 is shown by reference line 118. As can be seen in FIG. 17, the reference line 118 is located inwardly from the lower portion 104 of the rear leg 16B. In this manner, the rear leg 16B is able to provide additional stability to prevent the classroom chair 10 from tipping backward when the occupant 116 is in this seated position. In addition, the pair of side legs 16C and 16D are located rearward from the transverse axis, which additionally aids in preventing tipping of the classroom chair 10.

Figure 18:
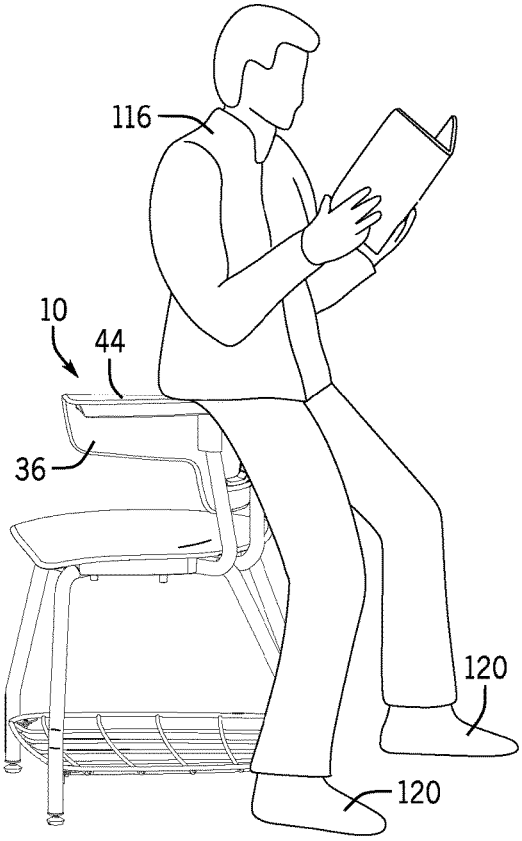
FIG. 18 is a view showing a second possible seating position.

FIG. 18 provides another alternate use of the classroom chair 10. In the embodiment shown in FIG. 18, the seat occupant 116 is leaning against the backrest 36 while the occupant's feet 120 are on the floor. Once again, the weight of the user is supported on the utility surface 44.

FIGS. 19-26 illustrate possible different seating positions for an occupant 116 within the classroom chair 10. The views of FIGS. 19-26 illustrate the wide variety of different types of uses that are available utilizing the classroom chair 10 of the present disclosure.

Figure 19:
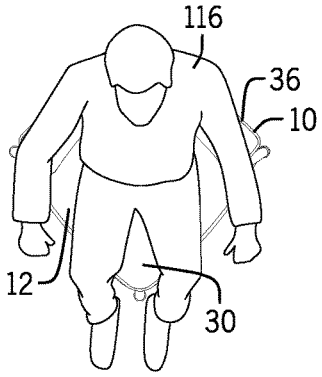
FIG. 19 discloses a first seating position utilizing the classroom chair of the present disclosure.

FIG. 19 illustrates the position of the occupant 116 facing directly forward in which the front portion 30 of the seat 12 is between the legs of the occupant. In this position, the occupant's back is supported by the center section of the backrest 36.

Figure 20:
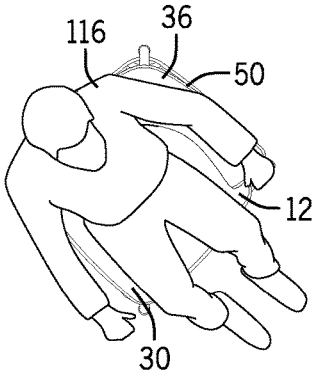
FIG. 20 discloses a second seating position utilizing the classroom chair of the present disclosure.

FIG. 20 illustrates a seating position in which the occupant 116 is facing toward the left of center. In this location, one of the armrest sections 50 of the backrest 36 supports the user's back while the user's legs are located to the left of the front 30 of the seat 12.

Figure 21:
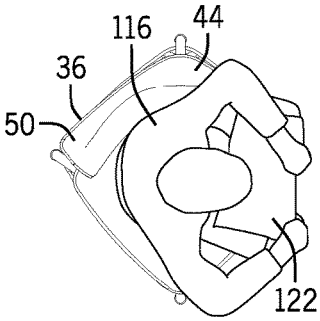
FIG. 21 discloses a third seating position utilizing the classroom chair of the present disclosure.

FIG. 21 illustrates the occupant turned further to the left in which the occupant can utilize the utility surface 44 of the backrest 36 to support a work object 122. In this configuration, the occupant 116 can support the work object 122 on the backrest 36 while the armrest section 50 can provide some support for the occupant's back.

Figure 22:
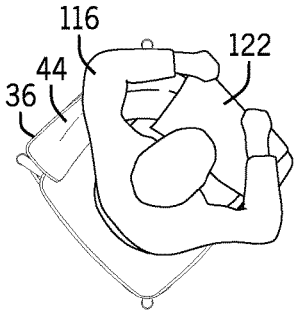
FIG. 22 discloses a fourth seating position utilizing the classroom chair of the present disclosure.

FIG. 22 illustrates the occupant 116 turned further to the left. Once again, the work object 122 is supported on the utility surface 44 of the backrest 36. In this position, both of the occupant's legs are located on the same side of the pair of support tubes that provide the mounting support for the backrest 36.

Figure 23:
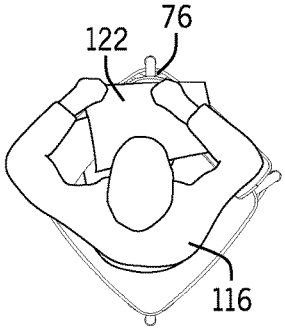
FIG. 23 discloses a fifth seating position utilizing the classroom chair of the present disclosure.

In the seating position shown in FIG. 23, the occupant 116 has turned completely toward the rear of the chair. In this position, each of the occupant's legs will be located on opposite sides of the center section 48 (see FIG. 1). In this location, the user's legs will be below the lower edge 54 of each of the armrest sections 50 while the pair of support tubes 40 will be located between the occupant's legs. In this position, the work object 122 is positioned on a portion of the utility surface located nearest to the apex 76.

Figure 24:
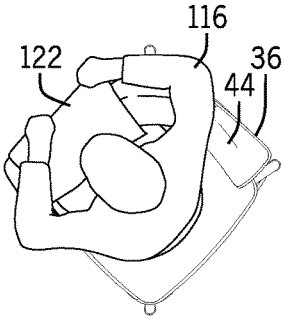
FIG. 24 discloses a sixth seating position utilizing the classroom chair of the present disclosure.

FIG. 24 is similar to FIG. 22 except that the occupant 116 has turned further to the left and thus the work object 122 is supported on the utility surface on the opposite armrest portion of the backrest 36.

Figure 25:
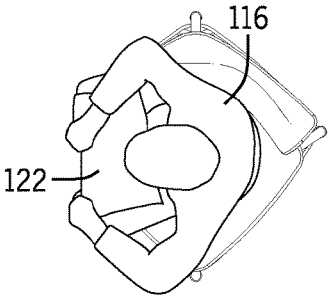
FIG. 25 discloses a seventh seating position utilizing the classroom chair of the present disclosure.

FIG. 25 is similar to FIG. 21 in which the occupant 116 has turned further such that the work object 122 is supported on the opposite armrest portion and the user's back is supported by the opposite armrest portion.

Figure 26:
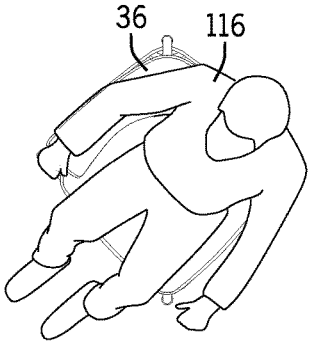
FIG. 26 discloses an eighth seating position utilizing the classroom chair of the present disclosure.

Finally, FIG. 26 is similar to FIG. 22 in which the occupant 116 is turned far enough such that the armrest portion of the backrest 36 supports the back of the occupant.

As can be understood in the illustrations shown in FIGS. 19-26, the unit configuration of the classroom chair, and specifically the configuration of the backrest 36, allows the occupant 116 to sit in a wide variety of positions depending upon the present requirement. The backrest 36 allows the occupant to support a work object and utilize the utility surface as a writing surface.

We claim:

1. A classroom chair comprising:

a base;

a seat mounted to the base and having a seating surface generally located in a seating plane; and a backrest including a back support surface and a utility surface, wherein the back support surface is perpendicular to the seating plane and the utility surface is located in a support plane that is generally parallel to the seating plane wherein the backrest includes a center section and a pair of armrest sections extending from the center section, wherein each of the armrest sections and the center section form a portion of the back support surface and the utility surface;

wherein the seat and backrest are centered along a seating axis, wherein the utility surface of the center section includes an apex positioned along the seating axis; and wherein the portion of the back support surface in the center section extends below a lower edge formed on the back support surface of the armrest sections.

2. The classroom chair of claim 1 wherein the base includes four legs extending below the seat, wherein two of the legs are positioned on the seating axis and two of the legs are positioned on opposite sides of the seating axis.

3. The classroom chair of claim 2 wherein one of the legs positioned on the seating axis extends past the apex of the center section.

4. The classroom chair of claim 1 wherein the utility surface is defined by an outer edge that includes the apex, wherein the outer edge extends in opposite orthogonal directions from the apex.

5. The classroom chair of claim 1 wherein the base includes only two legs extending below the seat, wherein a support frame is securely joined to the two legs of the base and is located along a lower support plane that is generally parallel to the seating plane.

6. The classroom chair of claim 5 wherein the support frame includes two stub legs mounted to extend below the support frame, wherein at least one of the stub legs is positioned on the seating axis.

7. The classroom chair of claim 6 wherein the at least one stub leg positioned on the seating axis extends past the apex of the center section.

8. The classroom chair of claim 5 further comprising a book rack mounted to the support frame.

9. The classroom chair of claim 8 wherein a plurality of classroom chairs can be stacked.

10. The classroom chair of claim 1 further comprising a backrest support frame centered along the seating axis and connected to the base, wherein the backrest is mounted to the backrest support frame.

11. The classroom chair of claim 2, wherein the classroom chair includes a transverse axis that bisects the seat and is perpendicular to the seating axis, wherein the two legs positioned on opposite sides of the seating axis are both positioned rearward of the transverse axis.

12. A classroom chair comprising:

a base including a plurality of legs;

a seat mounted to the base and having a seating surface generally located in a seating plane, wherein the seat is bisected by a seating axis and a transverse axis; and a backrest including a back support surface and a utility surface centered along the seating axis, wherein the back support surface is perpendicular to the seating plane and the utility surface is located in a support plane that is generally parallel to the seating plane, wherein the backrest includes a center section and a pair of armrests extending from the center section, wherein each of the armrests and the center section form a portion of the back support surface and the utility surface wherein the backrest includes a center section and a pair of armrest sections extending from the center section, wherein each of the armrest sections and the center section form a portion of the back support surface and the utility surface;

wherein the seat and backrest are centered along a seating axis, wherein the utility surface of the center section includes an apex positioned along the seating axis; and wherein the portion of the back support surface in the center section extends below a lower edge formed on the back support surface of the armrest sections.

13. The classroom chair of claim 12 wherein the utility surface of the center section includes an apex positioned along the seating axis.

14. The classroom chair of claim 12 wherein the base includes four legs extending below the seat, wherein two of the legs are positioned on the seating axis and two of the legs are positioned on opposite sides of the seating axis.

15. The classroom chair of claim 14 wherein the two legs positioned on opposite sides of the seating axis are both positioned rearward of the transverse axis.

16. The classroom chair of claim 12 wherein the base includes two legs extending below the seat, wherein the two legs are securely joined to a support frame located along a lower support plane that is generally parallel to the seating plane.

17. The classroom chair of claim 16 wherein the support frame include a plurality of support legs, wherein two of the support legs centered along the seating axis and two of the support legs are positioned on opposite sides of the seating axis and rearward of the transverse axis.

* * * * *